US006717543B2

(12) United States Patent
Pappert et al.

(10) Patent No.: US 6,717,543 B2
(45) Date of Patent: Apr. 6, 2004

(54) RADAR DEVICE FOR OBJECT SELF-PROTECTION

(75) Inventors: Gunnar Pappert, Altdorf (DE); Klaus Schlüter, Eckental (DE)

(73) Assignee: Diehl Munitionssysteme GmbH & Co. KG, Röthenbach (DE)

( * ) Notice: Subject to any disclaimer, the term of this patent is extended or adjusted under 35 U.S.C. 154(b) by 0 days.

(21) Appl. No.: 10/276,362

(22) PCT Filed: May 16, 2001

(86) PCT No.: PCT/EP01/05589

§ 371 (c)(1),
(2), (4) Date: Nov. 15, 2002

(87) PCT Pub. No.: WO01/88564

PCT Pub. Date: Nov. 22, 2001

(65) Prior Publication Data

US 2003/0117309 A1 Jun. 26, 2003

(30) Foreign Application Priority Data

May 17, 2000 (DE) ..... 100 24 320

(51) Int. Cl.[7] ..... G01S 7/36

(52) U.S. Cl. ..... 342/13; 342/16; 342/17; 342/67; 342/97; 342/153

(58) Field of Search ..... 342/13, 16, 17, 342/62, 67, 80, 90, 95, 96, 97, 149, 153

(56) References Cited

U.S. PATENT DOCUMENTS 4,008,869 A * 2/1977 Weiss ..... 244/3.13
4,224,507 A * 9/1980 Gendreu ..... 235/412
5,036,748 A * 8/1991 Pendry ..... 89/36.13
5,340,056 A * 8/1994 Guelman et al. ..... 244/3.16
5,464,174 A * 11/1995 Laures ..... 244/3.11
5,662,291 A * 9/1997 Sepp et al. ..... 244/3.13
5,917,442 A * 6/1999 Manoogian ..... 342/62
5,992,292 A * 11/1999 Ennenga ..... 89/41.22
6,087,974 A * 7/2000 Yu ..... 342/62
6,351,247 B1 * 2/2003 Linstrom et al. ..... 343/797
6,527,222 B1 * 3/2003 Redano ..... 244/3.14
6,575,400 B1 * 6/2003 Hopkins et al. ..... 244/3.19
6,421,025 B1 * 7/2003 Drize et al. ..... 343/853

FOREIGN PATENT DOCUMENTS

DE 100 24 320 C2 11/2001

OTHER PUBLICATIONS

"Analysis and design of shipboard defense missile system via statistical error approach", Li–Wei Fong; Jhu–Shi Dai; Cheng–Chiian Liu; Industrial Electronics, Control and Instrumentation, 1997. 23rd Int'l Conf. on , vol.: 1, Nov. 9–14, 1997 Ps: 132–137.*

"Tracking unresolved targets in theater ballistic missile defense", Belcher, M.; System Theory, 1997., Proceedings of the Twenty–Ninth Southeastern Symposium on , Mar. 9–11, 1997 pp.: 426–429.*

(List continued on next page.)

*Primary Examiner*—John B. Sotomayor
(74) *Attorney, Agent, or Firm*—Scully, Scott, Murphy & Presser

(57) ABSTRACT

In regard to radar guidance of a launch container (15) for fragmentation projectiles (16) for defending against an attacking missile (12), from the object (11) to be protected, the present invention affords a radar guidance system which can be inexpensively set up from existing components and which, in the absence of interfaces between the object (11) and the launch container (15), operates in a trouble-free manner if, for space monitoring and target acquisition, provided on the substructure (14) of the launch container (15) which is fixed with respect to the object, there is a planar antenna (20) which transmits its target information to a target-tracking radar (19) which is integrated into the launch container (15), for directly guiding the launch container (15) on to the approach of the missile (12) to be defended against.

3 Claims, 1 Drawing Sheet

OTHER PUBLICATIONS

Figure 1:
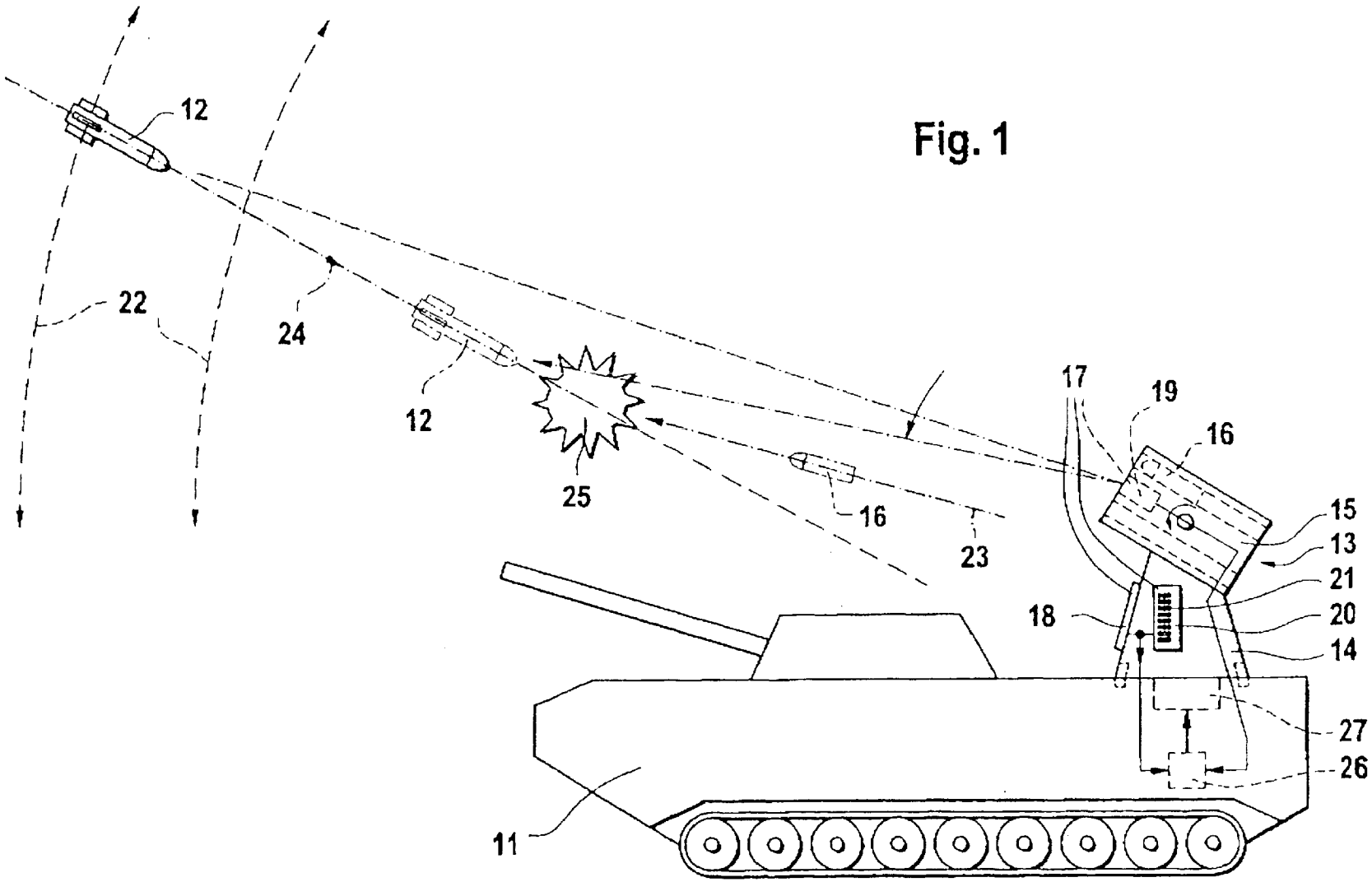

"Selection of parameters in the design of a naval fire control radar", As, B.–O.; Tilfors, E.; Radar Conference, 1990., Record of the IEEE International , May 7–10, 1990 Ps: 22–27.*

"EL/M 2080 ATBM early warning and fire control radar system", Dryer, S.; Levine, E.; Peleg, M.; Schrift, A.; Phased Array Systems and Technology, 1996., IEEE International Symposium on , Oct. 15–18, 1996 Ps: 11–16.*

*"Active Protection: providing a smarter shield for AFVs"*, RM Ogorkiewicz, et al., Janes International Defense Review (1999) pp. 31–38.

*"Shoot First, Ask Questions Later"*, Mark Hewish, et al., Janes International Defense Review (1996), pp. 33–36.

* cited by examiner

RADAR DEVICE FOR OBJECT SELF-PROTECTION

BACKGROUND OF THE INVENTION

1. Field of the Invention

The invention concerns a radar device with a planar antenna comprising grouped individual radiating devices for object self-protection against the threat from an attacking missile.

2. Discussion of the Prior Art

A radar device of that kind is known from DE 28 22 845 C2 in the form of a group antenna with electronically controlled beam sweep for panoramic scanning in order to be able to detect an approaching in-flight attacker at least in terms of the direction of attack but as far as possible also in respect of the instantaneous attack speed and range, and to be able to appropriately direct defence equipment. The preference there is for the arrangement of individual radiating devices in a spherical volume, over an arrangement in the form of planar group antennae which are rejected as being inappropriate because their beam focusing characteristics, because of varying projection on to the group arrangement, depend on the instantaneous sweep direction and also, with the usual arrangements, their focusing is markedly less sharp in the horizontal direction than in the vertical direction. However even when individual radiating devices are arranged in a staggered configuration in the form of a spherical shell, that still involves the problems of providing for an arrangement, which is mechanically stable in terms of vibration and oscillation, of the spherical structure which stands up high, on the object when it is moving over rough terrain, and functionally critical interfaces between the object which carries such a radar device and the defence equipment which is to track the approaching in-flight attacker in a highly dynamic manner, for self-protection of the object. A particular bottleneck is the sufficiently fast echo evaluation of the very large number of individual radiating devices, having regard to their current geometrical configuration, in relation to the attacker which is approaching very fast and close.

SUMMARY OF THE INVENTION

Therefore the object of the present invention is to provide a radar device of the general kind set forth, which with simple, tried-and-tested technology, is suitable in particular for fast aiming and tracking of a launch container with fragmentation shells or projectiles against the approach flight of a remotely controlled or self-steering missile to a short residual distance, as is described as a self-protection system in U.S. Pat. No. 5,661,254 A or in DE 199 51 915.3 of Oct. 28, 1999, which has not yet been published (reference is made thereto in respect of full content herein to supplement the description of the invention set forth hereinafter, for the avoidance of repetition).

In accordance with the invention set forth in the main claim, to attain that object, recourse is had to the planar antenna which is expressly rejected precisely for such functions in the prior publication relating to the general kind of device involved. It is now arranged as a frequency-scanning monitoring radar directly on the substructure, which is fixed with respect to the object, of the aiming drive for the launch container and is modularly so dimensioned that its aiming characteristic which is pivotable immaterially through about ±90° scans in Doppler-sensitive fashion practically half the azimuth ahead with moderate azimuth direction-finding sharpness but a high degree of elevational direction-finding sharpness. That affords information which admittedly is initially only rough but which is fast, relating to the instantaneous approach co-ordinates of an attacker and the motion data thereof, in order to orient the launch container with its defence fragmentation projectiles in that direction. Now, in the determined segment of space, additional high-resolution target-tracking radar comes into operation for precise target acquisition and tracking in order to direct the operative direction of the launch container to the target and thereafter to launch the projectiles in the optimum approach situation.

For that purpose the target-tracking radar, designed for example in the form of a mono-pulse system, is integrated in axis-parallel relationship directly into the launch container. As a result there is no need for the procedure, which is demanding in terms of computing power and critical in respect of time, of converting the target direction co-ordinates and transferring them from the tracking system to the directional control of the launch container. On the contrary, the attacker is interpreted as the target in accordance with the rough vectoring from the monitoring radar directly in the operative direction of the defence projectiles, the target then being tracked with the launch container in a fine tracking procedure. The launch system would in any case have to be oriented towards the target. Therefore, combining together in terms of apparatus target acquisition of the launch arrangement and the tracking radar, in accordance with the invention, affords a time saving and simplified control parameters. This means that the control member for the directional drives of the launch container is acted upon directly firstly by the monitoring radar and thereafter by the target-tracking radar, without first having to transform co-ordinate systems. That therefore inevitably affords an ideal kinematics because the operative direction of the launch container directly follows the target movement relative to the object to be protected in order to provide that, when an operatively optimised spacing for the function of the defence fragmentation projectiles is reached, they are fired off against the target which has long been acquired.

BRIEF DESCRIPTION OF THE ACCOMPANYING DRAWING

In regard to additional advantages, alternatives and developments of the invention, besides referring to the further claims, reference is also made to the description hereinafter of a preferred embodiment of the structure according to the invention, which is diagrammatically shown in the drawing in highly abstracted form, being limited to what is essential, and not true to scale.

DETAILED DESCRIPTION OF PREFERRED EMBODIMENTS

FIG. 1 shows a diagrammatic scenario the defence against an attacking missile in relation to an armoured vehicle to be protected.

The object 11 under threat which is stationary or, as here, mobile, is provided for its own protection against the threat of an attacking missile 12 with a launch device 13 which, to detect half the hemisphere ahead, is equipped on a substructure 14 which is fixed with respect to the object, with a launch container 15 for high-speed fragmentation projectiles 16, the launch container 15 being pivotable in respect of azimuth and directionable in respect of height. The projectiles 16 are to be fired against the attacking missile 12 which is already close to the object 11, in order to interfere with the approach trajectory of the missile 12 in the final phase and thus at the same time as far as possible to destroy the sensor means or the structure of the missile so that it can no longer act on the targeted object 11 with its original effect but at most still with a non-lethal residual effect.

For that interception procedure at a short remaining distance, the launch carriage 13 is equipped with a radar device 17 which is distributed on the substructure 14 which is fixed with respect to the object and on the directionable launch container 15, in such a way that a monitoring radar 18 of relatively low resolution is arranged on the substructure 14 which is fixed on the object, and a target-tracking radar 19 which in contrast is very precise is arranged on the pivotable launch container 15. The monitoring radar 18 serves to observe the environment in the potential direction of danger and for that purpose is provided with a modular planar antenna, the individual radiating devices 21 of which are grouped per module respectively in rows and columns to form a substantially vertically extending array. One module is oriented ahead, two further modules are oriented ahead displaced laterally somewhat inclinedly in relation thereto, as diagrammatically indicated in the drawing. That effects a substantially horizontal scanning motion 22 with good vertical and moderate horizontal focusing in a manner which is known as such, by way of electronic beam shaping and beam sweep, in order over a wide detection region to obtain as quickly as possible elevational information, which is as accurate as possible, about a flying object or missile 12 which for example is carrying out an attack.

If in that situation an approaching missile 12 is detected and verified in one of the cyclically detected segments of space, the monopulse target-tracking radar 19 is switched on to that segment of space, insofar as immediately the directional axis of the launch container is directly oriented thereto in order then to precisely acquire that missile 12 in the roughly predetermined direction, with the strongly focussed characteristic for example of an axis-parallel parabolic, Cassecrain or planar radiating device. The launch unit 13 therefore locks on to its target from that time on. That means that the active axis 23 of the launch container 15, along which the fragmentation projectiles or grenades. 16 are launched against the missile 12 which has then approached sufficiently closely, is immediately and directly pivoted on to that target and the active axis 23 of the launch container 15 is then necessarily always caused to track that target 12 with the tracking radar 19 without that requiring, from that time on, still further conversion and transfer of directional data between a radar device which is fixed with respect to the object, and the defence mechanism of the object.

The approach movement 24 of the missile 12 which is to be defended against is thus tracked until the fragmentation projectiles or grenades 16 are fired off shortly before the trajectory collision point 25 by the target-tracking radar 19, until it has approached so closely to the object 11 to be protected, in order to be able to fire off the defence projectiles 16 with sufficient prospects of success against the attacking missile 12.

Accordingly, in regard to radar guidance of a launch container 15 for fragmentation projectiles or grenades 16 for defending against an attacking missile 12, from the object 11 to be protected, the present invention consequently affords a radar guidance system which can be inexpensively set up from existing components and which, in the absence of interfaces between the object 11 and the launch container 15, operates in a trouble-free manner in the final phase which is particularly functionally critical, if, for space monitoring and target acquisition, provided on the substructure 14 of the launch container 15 which is fixed with respect to the object, there is a planar antenna 20 for rapid initial detection, which transmits its rough target information to a target-tracking radar 19 which is integrated into the launch container 15, for directly vectoring the launch container 15 on to and tracking it on the approach of the missile 12 to be defended against. For that purpose the two functional parts of the radar device 17, which are operative in succession, are connected to the positioning control unit 26 for the drives for effecting aiming and tracking of the launch container 15.

What is claimed is:

1. A radar device (17) with a planar antenna (20) comprising grouped individual radiating devices (21) for object self-protection against the threat from an attacking missile (12), characterised in that the individual radiating devices (21) are arranged in at least one vertically oriented group as monitoring radar (18) on the substructure (14), which is fixed with respect to the object, of a launch container (15) for fragmentation projectiles (16), which in turn is provided with a target-tracking radar (19) vectored by the monitoring radar (18) for the approach movement (24) of the missile (12) to be defended against, and said monitoring radar (18) and the target-tracking radar (19) are both connected to a positional control device (26) for the drives (27) for spatial orientation and then for target tracking of the launch container (15).

2. A radar device according to claim 1 characterised in that the individual radiating devices (21) of the planar antenna (20) are grouped ahead in modules which are oriented pivotedly relative to each other for acquisition approximately of the half-hemisphere around the object (11) to be protected.

3. A radar device according to claim 1, characterised in that the target-tracking radar (19) is a monopulse radar which is vectored by the monitoring radar (18).

* * * * *